US007874619B2

(12) United States Patent
Harley

(10) Patent No.: US 7,874,619 B2
(45) Date of Patent: Jan. 25, 2011

(54) ADJUSTABLE LUMBAR SUPPORT FOR A CHAIR BACK

(75) Inventor: Alexander Petrie Harley, Oakville (CA)

(73) Assignee: Allseating Corporation, Mississauga (CA)

( * ) Notice: Subject to any disclaimer, the term of this patent is extended or adjusted under 35 U.S.C. 154(b) by 272 days.

(21) Appl. No.: 11/698,957

(22) Filed: Jan. 29, 2007

(65) Prior Publication Data

US 2008/0179930 A1 Jul. 31, 2008

(51) Int. Cl.
*A47C 7/46* (2006.01)

(52) U.S. Cl. ..... 297/284.4

(58) Field of Classification Search ..... 297/337, 297/284.1, 284.4, 284.2, 284.7
See application file for complete search history.

(56) References Cited

U.S. PATENT DOCUMENTS 3,762,769 A * 10/1973 Poschl ..... 297/284.4
4,632,454 A * 12/1986 Naert ..... 297/284.4
5,553,917 A * 9/1996 Adat et al. ..... 297/230.14
5,582,459 A * 12/1996 Hama et al. ..... 297/300.2
5,718,476 A 2/1998 De Pascal et al.
6,045,185 A * 4/2000 Ligon et al. ..... 297/284.4
6,050,641 A * 4/2000 Benson ..... 297/284.4
6,099,076 A * 8/2000 Nagel et al. ..... 297/337
6,254,186 B1 * 7/2001 Falzon ..... 297/284.1
6,338,530 B1 * 1/2002 Gowing ..... 297/284.4
6,431,648 B1 * 8/2002 Cosentino et al. ..... 297/284.4
6,536,840 B1 * 3/2003 Schuster et al. ..... 297/284.1
6,572,190 B2 6/2003 Koepke et al.
6,805,405 B2 * 10/2004 Koo ..... 297/284.7
6,811,218 B2 11/2004 Deimen et al.
6,848,744 B1 2/2005 Raftery et al.
7,066,537 B2 * 6/2006 Coffield et al. ..... 297/284.4
7,422,287 B2 * 9/2008 Heidmann et al. ..... 297/354.1
2002/0130541 A1 * 9/2002 Koo ..... 297/284.7
2002/0180248 A1 * 12/2002 Kinoshita et al. ..... 297/284.1
2004/0140701 A1 * 7/2004 Schmitz et al. ..... 297/284.4
2004/0245824 A1 * 12/2004 McMillen ..... 297/284.4
2005/0104428 A1 * 5/2005 Walker et al. ..... 297/284.4
2005/0275263 A1 * 12/2005 Norman et al. ..... 297/284.4
2006/0001303 A1 * 1/2006 Raftery et al. ..... 297/284.2
2006/0138829 A1 * 6/2006 Kopetzky et al. ..... 297/284.1
2007/0057548 A1 * 3/2007 Buffa ..... 297/284.4
2007/0057549 A1 * 3/2007 Ball et al. ..... 297/284.4
2007/0138851 A1 * 6/2007 Yevko et al. ..... 297/284.1
2008/0272636 A1 * 11/2008 Machael et al. ..... 297/284.4
2009/0127905 A1 * 5/2009 Schmitz et al. ..... 297/284.4

* cited by examiner

*Primary Examiner*—Milton Nelson, Jr.
(74) *Attorney, Agent, or Firm*—Macleod Dixon LLP

(57) ABSTRACT

An adjustable lumbar support for a chair back having a frame with a top end and a bottom end. The frame has a series of flexing zones and a series of control zones. The adjustable lumbar support for a chair back further includes a support having a first end and a second end. The first end of the support is adapted to engage the top end of the frame. The lumbar support also includes an adjusting means adapted to adjust the support in a vertical plane for flexing of the frame and the chair back in a horizontal plane. The adjusting means is also adapted to engage the second end of the support and adapted to engage the bottom end of the frame. The frame is mounted to the chair back.

15 Claims, 7 Drawing Sheets

ADJUSTABLE LUMBAR SUPPORT FOR A CHAIR BACK

FIELD OF THE INVENTION

This invention relates in general to and more particularly to adjustable support for a chair back and more particularly an adjustable lumbar support for a chair back.

BACKGROUND OF THE INVENTION

There are wide variety of office chairs that have been designed to be more ergonomic and provide a variety of different functions and adjustments. These adjustments generally include height and back support and more specifically lumbar support for the spine and the back in general that are susceptible to the harmful effects of a prolonged sitting position. In general lumbar supports have included adjustments to the height of the lumbar support relative the chair back so that the spinal support can be adjusted relative to the height of the individual. Other adjustment mechanisms have focused on adjusting the depth of spinal support that the lumbar support can provide.

Prior art lumbar supports have been devised to address the noted problems. For example, U.S. Pat. No. 6,572,190 issued on Jun. 3, 2003 to Koepke e al. This patent relates to a lumbar support for a chair having a flexible back, includes at least one generally vertical support member disposed to the rear of the chair back. A transverse member engages the vertical support and has opposed ends provided with grippers for gripping opposed edges of the flexible back. The transverse member is configured to force the opposed edges of the flexible back forwardly of the chair back in the lumbar region of the user to provide support.

De Pascal et al. is the owner of U.S. Pat. No. 5,718,476 which issued on Feb. 17, 1998. This patent relates to an office chair has a seat supported by a base. A seat back is resiliently attached to the seat. A pair of axles support upper cams and lower cams, respectively. A stiff, flexible sheet is attached to the seat back and extends over and is supported by the upper and lower cams. As a mechanical linkage which interconnects the cams with each other and an operator controlled knob coordinately rotates the cams, the curvature of the flexible sheet continuously changes its contour. More specifically, the contour flows such that a salient point (S) of maximum contact with the lumbar region of the user shifts in a vertical direction (h) and in a horizontal direction (e) simultaneously and concurrently.

Raftery et al. is the owner of U.S. Pat. No. 6,848,744 which issued on Feb. 1, 2005. This patent relates to a chair back comprises a back frame, a movable back support, and a contouring assembly. The back frame includes a portion rearward of the back support. The contouring assembly is coupled to the back support and the portion of the back frame. The contouring assembly pulls the back support toward the portion of the back frame. The present invention is also directed to a chair including such a chair back.

Deimen et al. is the owner of U.S. Pat. No. 6,811,218 which issued on Nov. 2, 2004. This patent relates to a task chair including a seat support structure, and a seat supported by the seat support structure and having a seating surface which may ergonomically conform to a seated user. The seating surface includes rigid and flexible portions connected to one another, the flexible portions allowing resilient flexing of the seating surface to create conformance zones which dynamically support a seated user in an ergonomic manner.

Thus an adjustable lumbar support for a chair back which is easy for the individual to adjust, includes flexing zones that maintains the ergonomics of the chair back, provides improved spinal support, allows for lumbar support along a horizontal plane therefore adjusting the entire chair back, and is not visible through the chair back is desirable.

SUMMARY OF THE INVENTION

An object of one aspect of the present invention is to provide an improved adjustable lumbar support for a chair back.

In accordance with one aspect of the present invention there is provided an adjustable lumbar support for a chair back having a frame with a top end and a bottom end. The frame has a series of flexing zones and a series of control zones. The adjustable lumbar support for a chair back further includes a support having a first end and a second end. The first end of the support is adapted to engage the top end of the frame. The lumbar support also includes an adjusting means adapted to adjust the support in a vertical plane for flexing of the frame and the chair back in a horizontal plane. The adjusting means is also adapted to engage the second end of the support and adapted to engage the bottom end of the frame. The frame is mounted to the chair back.

Conveniently, the series of flex zones are an upper flex zone and a lower flex zone wherein the upper and lower flex zones of the frame flex out along a horizontal plane when the adjusting means is engaged in an upward direction along the vertical plane, and flex in along a horizontal plane when the adjusting means is engaged in a downward direction.

Preferably, the support is wish boned-shaped and has two members that extend to the first end of the support and mount to the top end of the frame. The wish boned-shaped support has a mounting bracket at the second end of the support that is mounted to the adjusting means.

In accordance with another aspect of the present invention there is provided an adjustable lumbar support for a chair back having a frame with a top end and a bottom end. The frame has a series of flexing zones and a series of control zones. The adjustable lumbar support for a chair back further includes a support having a first end and a second end. The first end of the support is adapted to engage the top end of the frame. The lumbar support also includes a first adjusting means adapted to adjust the support in a vertical plane for flexing of the frame and the chair back in a horizontal plane. The lumbar support also has a second adjusting means adapted to adjust a chair seat along a horizontal plane when the first adjusting means is engaged. The adjusting means is also adapted to engage the second end of the support and adapted to engage the bottom end of the frame. The frame is mounted to the chair back.

Advantages of the present invention are: the adjustable lumbar support does not attach to chair back at the traditional lumbar area; the adjustable lumbar support actually changes the entire chair back itself and not just the immediate lumbar area of the chair back; provides improved lumbar support over typical lumbar supports; improved lumbar support to a wide variety of body types as the entire chair back and chair seat can be adjusted to grow with the individual, adjustable lumbar support is not visible through a mesh chair back, and has adjustable flexing zones.

BRIEF DESCRIPTION OF THE DRAWINGS

A detailed description of the preferred embodiments is provided herein below by way of example only and with reference to the following drawings, in which.

Figure 1:
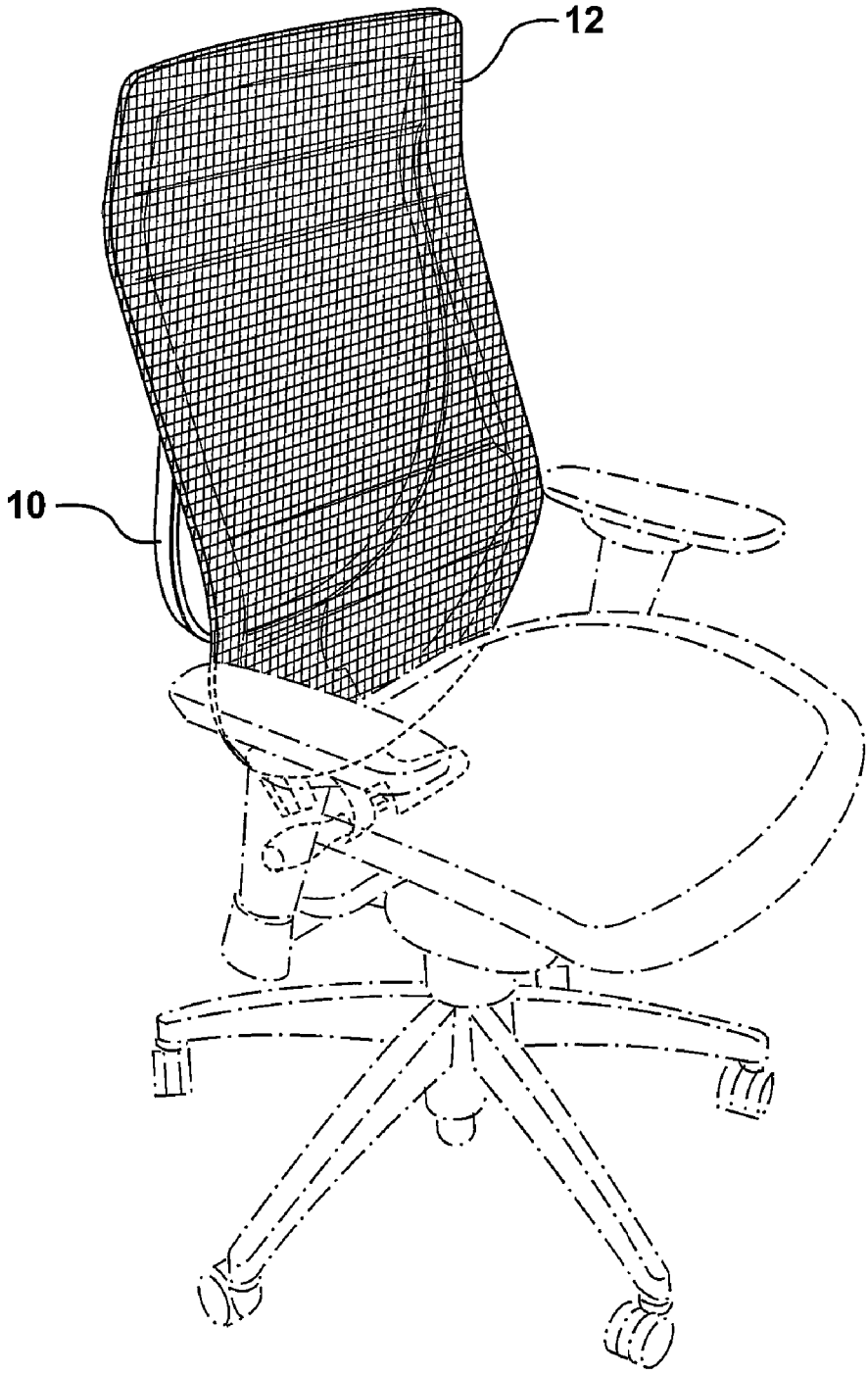
FIG. 1 in a perspective view, illustrates an adjustable lumbar support for a chair back in accordance with a preferred embodiment of the present invention.
Figure 2:
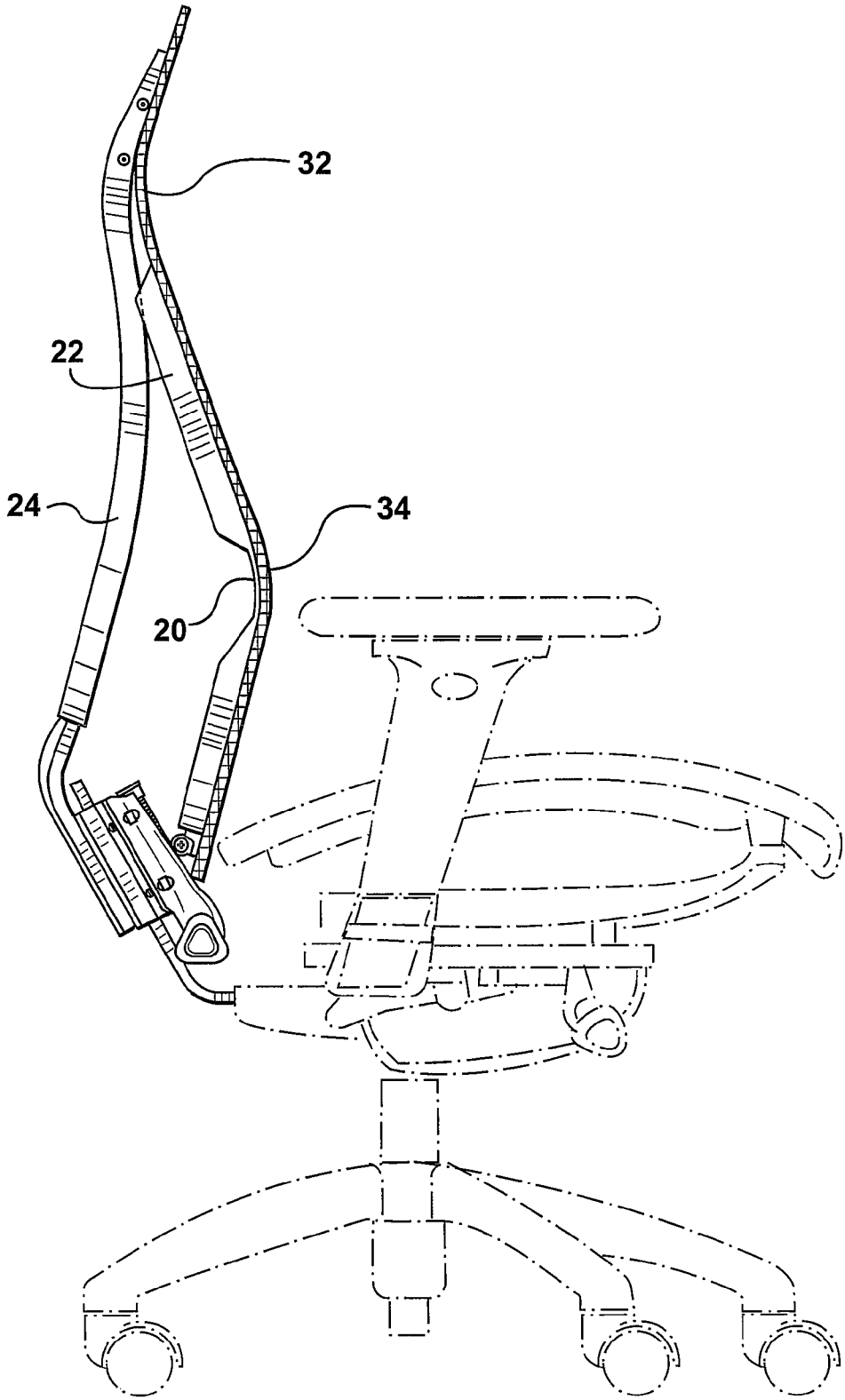
FIG. 2 in a side elevational view, illustrates the adjustable lumbar support of FIG. 1.
Figure 3:
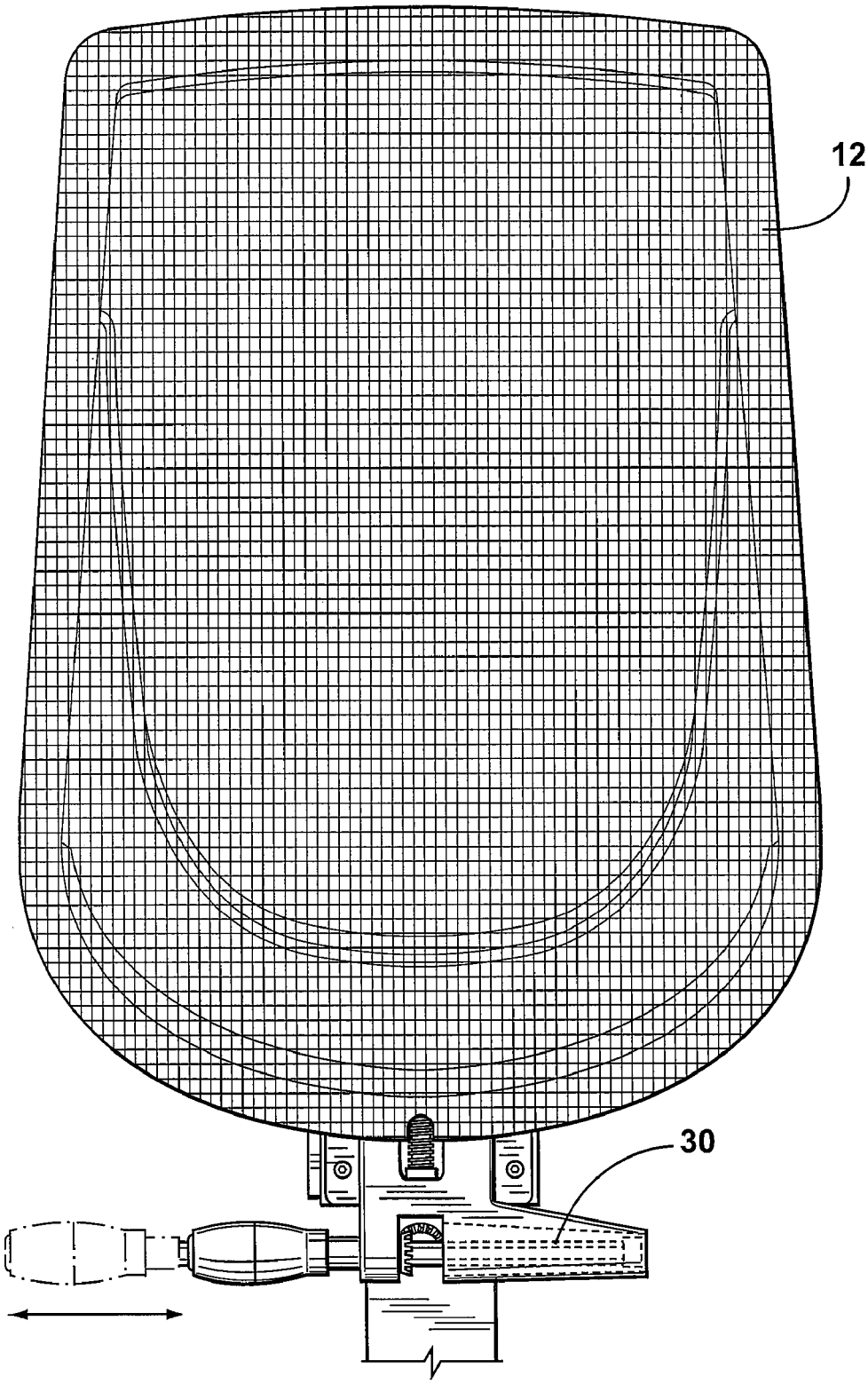
FIG. 3 in a front plan view, illustrates the adjustable lumbar support of FIG. 1.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

Referring to FIGS. 1 to 4*a*, there is illustrated in a perspective, front, back and a side views, an adjustable lumbar support 10 for a chair back 12 in accordance with a preferred embodiment of the present invention. The adjustable lumbar support 10 for a chair back 12 has a frame 14 that has a top end 16 and a bottom end 18. The frame 14 has a series of flexing zones 20 and a series of control zones 22. The adjustable lumbar support 10 for a chair back 12 further includes a support 24 having a first end 26 and a second end 28. The first end 26 of the support 24 is adapted to engage the top end 16 of the frame 14. The adjustable lumbar support 10 also includes an adjusting means 30 adapted to adjust the support 24 in a vertical plane for flexing of the frame 14 and the chair back 12 in a horizontal plane. The adjusting means 30 is also adapted to engage the second end 28 of the support 24 and adapted to engage the bottom end 18 of the frame 14. The frame 14 is mounted to the chair back 12.

Referring to FIGS. 4*b*-4*e*, the frame 14 may be better defined as a structure 40 that follows the shape of the perimeter 38 of the chair back 12. The structure 40 has additional support 36 at the control zones 22 so that the control zones 22 are rigid and therefore do not flex as the support 24 is adjusted. Typically the additional support 36 may be reinforcement members made out of steel by way of example only. The control zones 22 therefore provide support to the individual even though they do not flex. Typically the control zones 22 are defined as a mid control zone 42 for supporting the mid back of the individual, and lower control zone 44 that supports the individual's seat. The first end 26 of the support 24 is securely mounted to the top end 16 of the frame 14 to provide rigid support for the individual's head and neck.

The series of flexing zones 20 include an upper flex zone 32 and a lower flex zone 34. The series of flexing zones 20 on the frame 14 allow for a flexing area at different points on the frame 14 and therefore the chair back 12. The flexing of the frame 14 and the chair back 12 occurs on a horizontal plane and therefore the flexing zones 20 allow for the flexing of the frame 14 and the chair back 12 to provide increased support as the chair back 12 and the frame 14 flex out away from the support 24. When the frame 14 and the chair back 12 flex back towards the support 24, the support in the chair back 12 decreases. The upper flex zone 32 provides support to the individual at the shoulder area and the lower flex zone 34 provides support at the lower back or lumbar region.

Figure 4A:
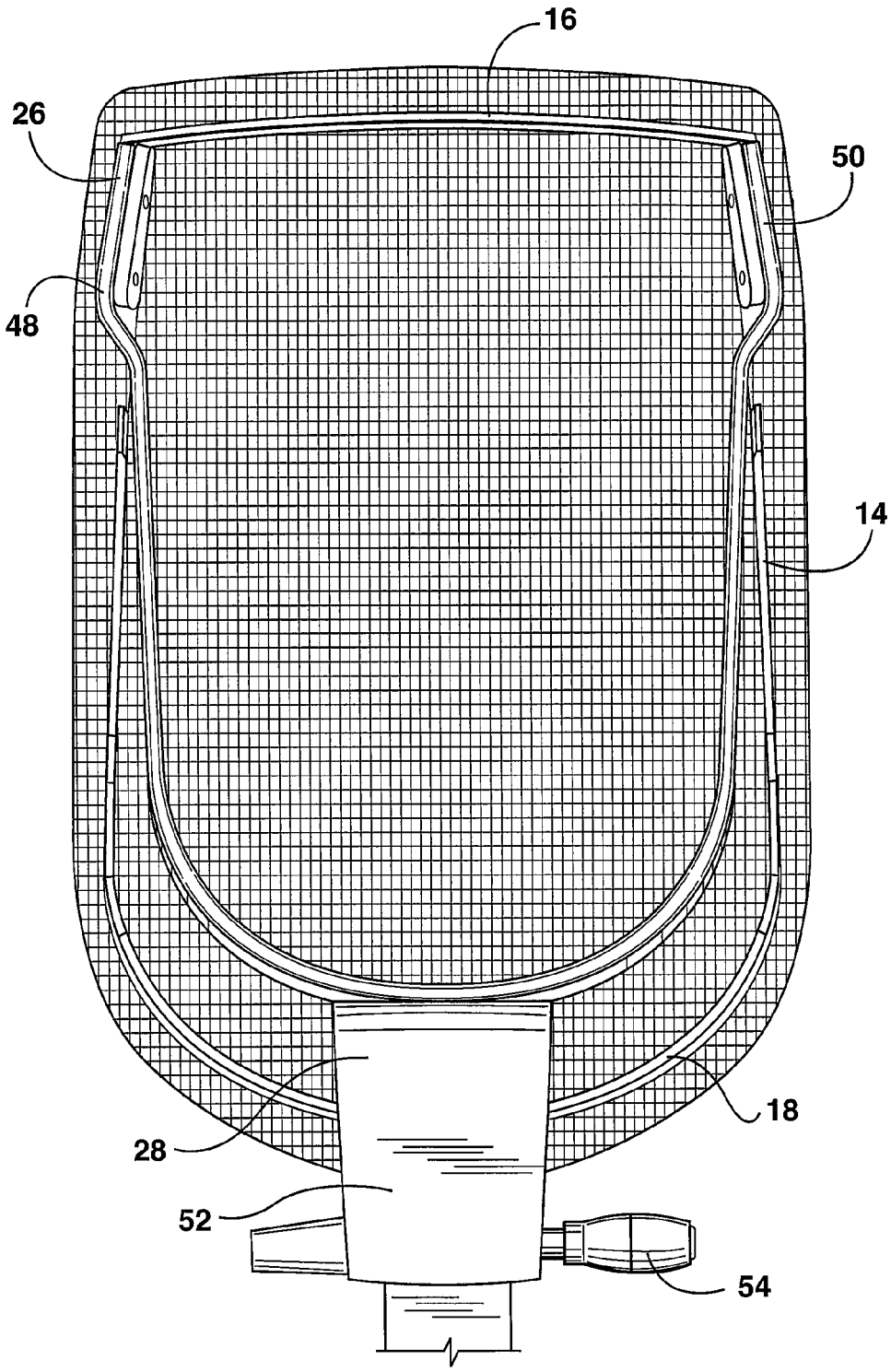
FIG. 4*a* in a back plan view, illustrates the adjustable lumbar support of FIG. 1.

Referring to FIG. 4*a* the support 24 can be wish boned-shaped 46 that has two members 48 and 50 that extend to the first end 26 of the support 24 and mount to the top end 16 of the frame 14. The wish boned-shaped support 26 further includes a mounting bracket 52 at the second end 28 of the support 24 that is mounted to the adjusting means 30. The wish boned shaped support 24 may follow structure 40 that follows the perimeter 38 of the chair back 12. As such the wish boned-shaped support 24 is not visible through the chair back 12 when the chair back 12 is made from mesh. The wish boned shaped support 24 may be made out of a wide variety of materials that allows for small degrees of flexion.

Figure 4B:
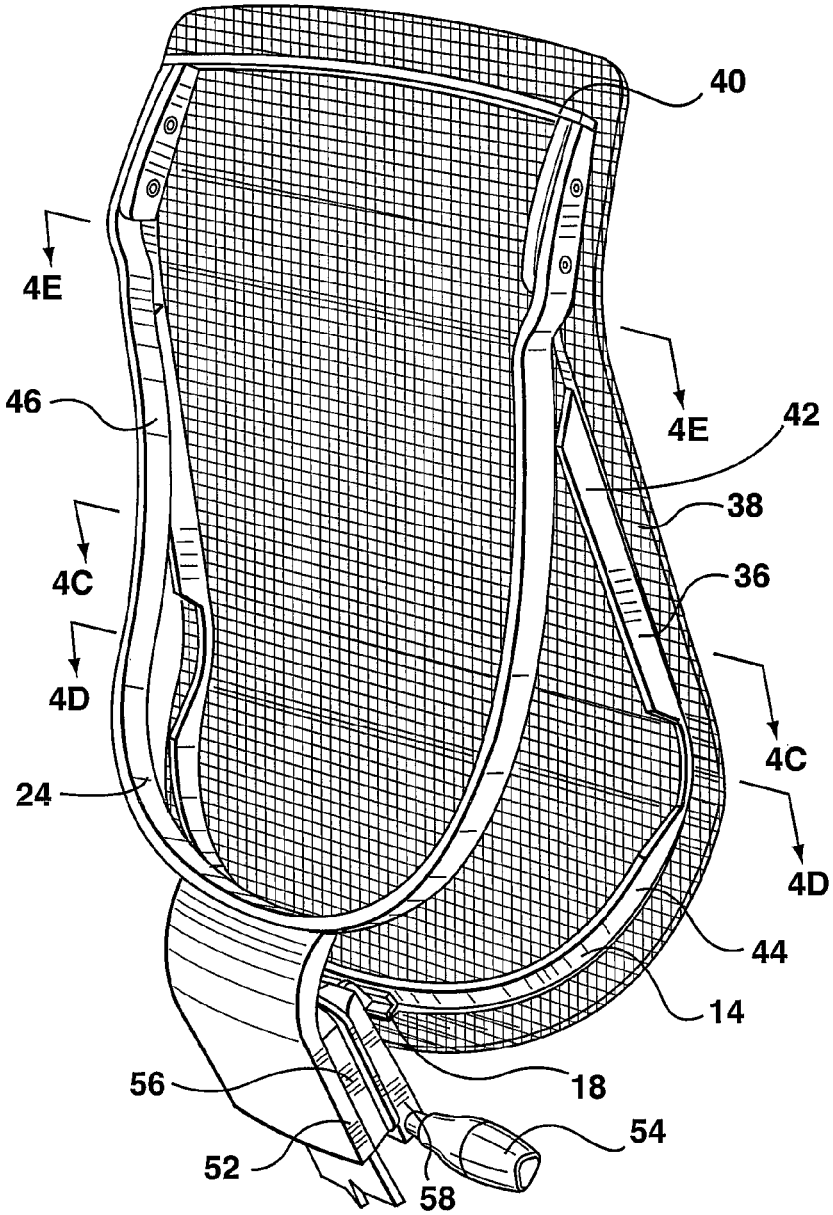
FIG. 4*b* in a perspective view, illustrates the adjustable lumbar support of FIG. 1.
Figure 4C:
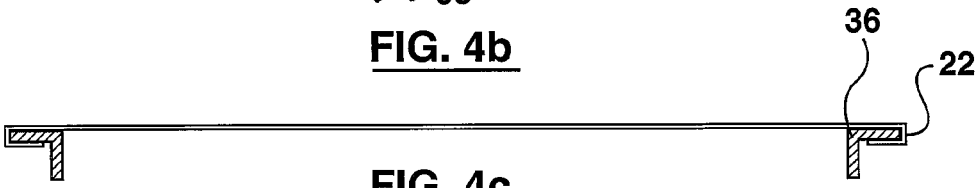
FIG. 4*c* in a cross-sectional view, illustrates the adjustable lumbar support of FIG. 4*b* along the line 4*c*-4*c*.
Figure 4D:
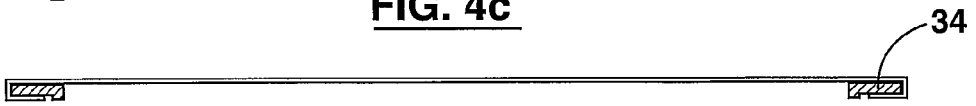
FIG. 4*d* in a cross-sectional view, illustrates the adjustable lumbar support of FIG. 4*b* along the line 4*d*-4*d*.
Figure 4E:
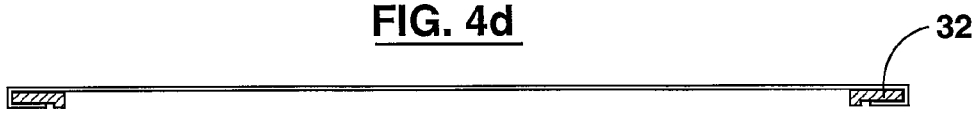
FIG. 4*e* in a cross-sectional view, illustrates the adjustable lumbar support of FIG. 4*b* along the line 4*e*-4*e*.
Figure 6:
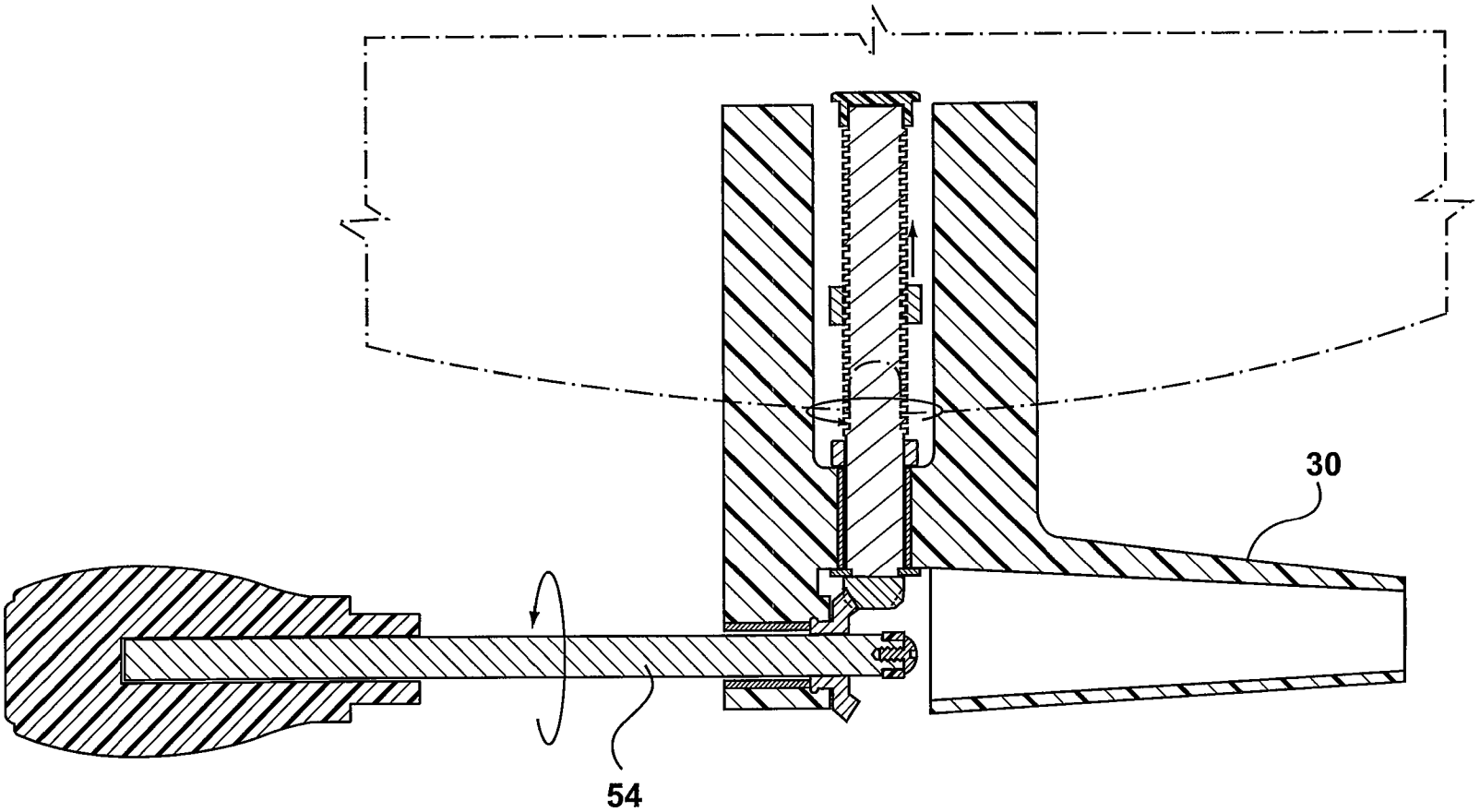
FIG. 6 in a cross-sectional view, illustrates the adjustable lumbar support of adjusting means of FIG. 5*a* along the line 6-6.

Referring to FIGS. 4*b* and 6 the adjusting means 30 may be further defined as a wide variety of adjusting mechanisms such 54 as a ratchet assembly, a thread assembly or pneumatic assembly by way of example only. The adjusting mechanism 54 is mounted to the mounting bracket 52 of the support 24 and is also mounted to the bottom end 18 of the frame 14. More particularly the adjusting mechanism 54 may be defined as having an adjusting portion 56 and a stationary portion 58. The mounting bracket 52 is mounted to the adjusting portion 56 of the adjusting mechanism 54. Therefore when the adjusting mechanism 54 is engaged to adjust the support for the chair back 12 the adjusting portion 56 moves relative the stationary portion 58 and therefore moves the mounting bracket 52, which subsequently moves or applies tension on the support 24.

This tension or movement is transmitted to the frame 14, which due to its unique construction results in the flexing zones 20 to be engaged. The flexing zones 20 therefore flex or move along the horizontal plane and the frame 14 and therefore the chair back 12 moves away from the support 24 and provide increased support at the flexing zones 20. The movement of the adjusting portion 56 occurs in the vertical plane yet the frame 14 and chair back move in the horizontal plane. The ability to adjust the frame 14 in this fashion results in the ability to adjust the entire chair back at the various flexing zones 20.

Figures 5A, 5B, 5C:
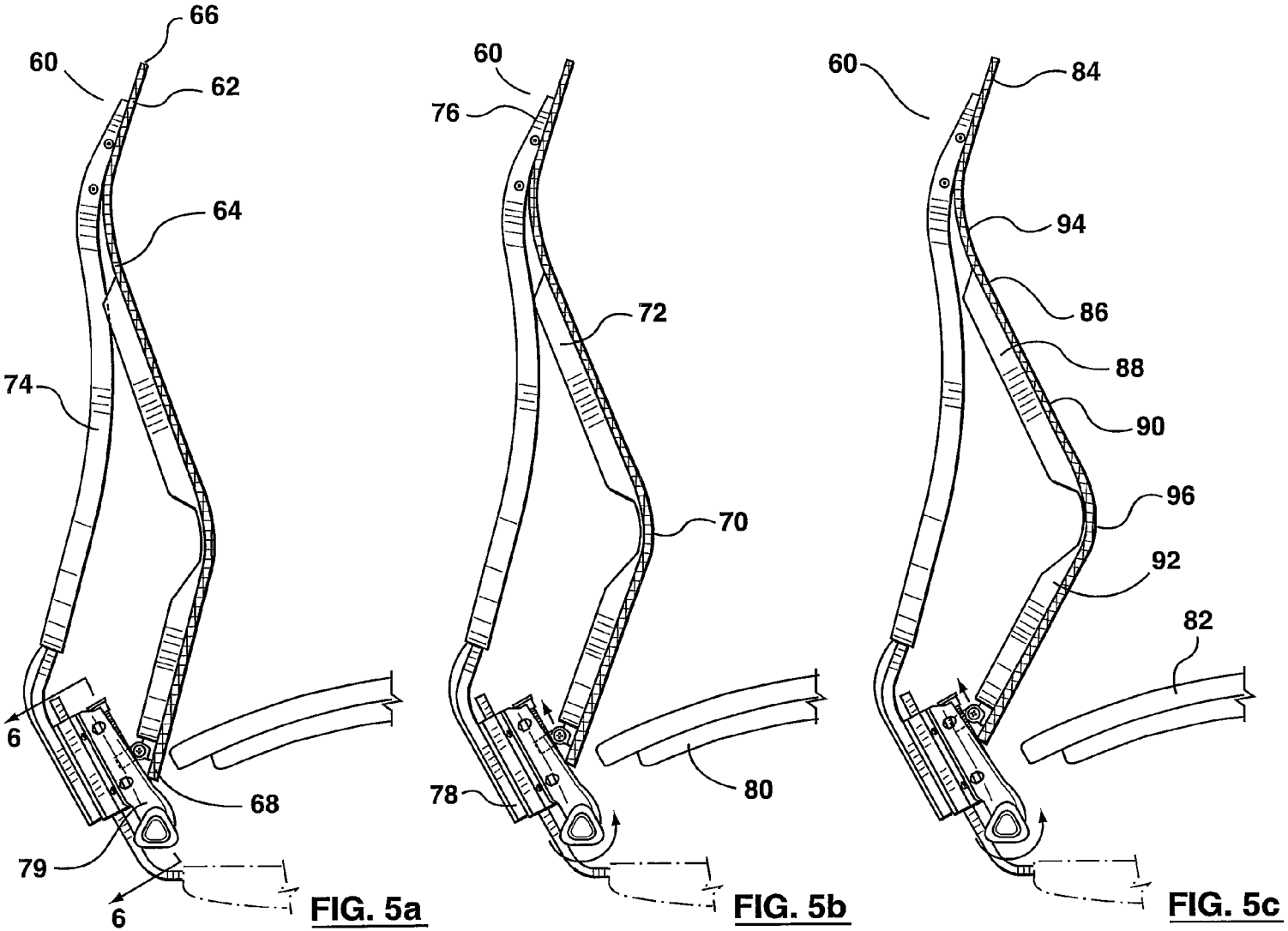
FIG. 5*a* in a side elevational view, illustrates the adjustable lumbar support of in accordance with a second embodiment of the present invention.
FIG. 5*b* in a side elevational view, illustrates the adjustable lumbar support of FIG. 5*a*.
FIG. 5*c* in a side elevational view, illustrates the adjustable lumbar support of FIG. 5*a*.

Referring to FIGS. 5*a* to 5*c* in accordance with another embodiment of the present invention there is provided an adjustable lumbar support 60 for a chair back 62 having a frame 64 with a top end 66 and a bottom end 68. The frame 64 has a series of flexing zones 70 and a series of control zones 72. The adjustable lumbar support 60 for a chair back 62 further includes a support 74 having a first end 76 and a second end 78. The first end 76 of the support 74 is adapted to engage the top end 66 of the frame 64. The lumbar support 60 also includes a first adjusting means 79 adapted to adjust the support 74 in a vertical plane for the flexing of the frame 64 and the chair back 62 in a horizontal plane.

The lumbar support 60 also has a second adjusting means 80 adapted to adjust a chair seat 82 along a horizontal plane when the first adjusting means 79 is engaged. The first adjusting 79 means is also adapted to engage the second end 78 of the support 74 and adapted to engage the bottom end 68 of the frame 64. The frame 64 is mounted to the chair back 62.

As noted above the frame 64 may be better defined as a structure 84 that follows the shape of the perimeter 86 of the chair back 62. The structure 84 has additional support 88 at the control zones 22 so that the control zones 72 are rigid and therefore do not flex as the support 74 is adjusted. Typically the additional support 88 may be reinforcement members made out of steel by way of example only. The control zones 72 therefore provide support to the individual even though they do not flex. Typically the control zones 72 are defined as a mid control zone 90 for supporting the mid back of the individual, and lower control zone 92 that supports the individual's seat. The first end 76 of the support 74 is securely mounted to the top end 66 of the frame 64 to provide rigid support for the individual's head and neck.

Similar to the first embodiment the series of flexing zones 70 include an upper flex zone 94 and a lower flex zone 96. The series of flexing zones 70 on the frame 64 allow for a flexing area at different points on the frame 64 and therefore the chair back 62. The flexing of the frame 64 and the chair back 62 occurs on the horizontal plane and therefore the flexing zones 70 allow for the flexing of the frame 64 and the chair back 62 to provide increased support as the chair back 62 and the frame 64 flex out away from the support 74. When the frame 64 and the chair back 62 flex back towards the support 74, the support in the chair back 62 decreases. The upper flex zone 94 provides support to the individual at the shoulder area and the lower flex zone 96 provides support at the lower back or lumbar region.

The support 74 and the first adjusting means 79 may be defined similarly to those elements in the first embodiment. The second adjusting means 80 allows for the horizontal adjustment of the chair seat 82 simultaneously as the first adjusting means 79 is adjusting the chair back 62. More specifically as the first adjusting means 79 is adjusted to provide increased support along the horizontal plane, the second adjusting means 80 adjusts the chair seat 82 also along the horizontal plane so as to provide the occupant of the chair seat sufficient support on the bottom of the user's legs. When the lumbar support 10 is adjusted to reduce the amount of support, the second adjusting means 80 adjusts the chair seat 80 back along the horizontal plane so that the occupant's legs are comfortable supported and not caught on the front edge of the chair seat 82. The second adjusting means 82 may be further defined as seat slider mechanism. In this way the chair seat 82 and the chair back 62 actually grows or changes with the occupant when the lumbar support 10 is adjusted.

Other variations and modifications of the invention are possible. All such modifications or variations are believed to be within the sphere and scope of the invention as defined by the claims appended hereto.

I claim:

1. An adjustable lumbar support on a chair back comprising: (a) a frame wherein the frame is further defined as a structure that is mounted to the chair back and mirrors a shape of a perimeter of the chair back, said frame having a top end and a bottom end, from the top end of the frame having an upper flex zone, a mid control zone, a lower flex zone and a lower control zone; (b) a support having a first end and a second end, the first end of the support is mounted only to the upper flex zone at the top end of the frame; (c) an adjusting means for moving the support solely in a vertical plane while allowing for the moving and flexing of the frame and the chair back solely in a horizontal plane; wherein the adjusting means is mounted only to the second end of the support and the adjusting means is only mounted to the bottom end of the frame.

2. An adjustable lumbar support on a chair back as claimed in claim 1 wherein the upper flex zone and the lower flex zone are spaced apart by the mid control zone and the lower control zone.

3. An adjustable lumbar support on a chair back as claimed in claim 1 wherein the upper and lower flex zones of the frame flex out along a horizontal plane when the adjusting means is moved in an upward direction solely along the vertical plane, and flex in solely along a horizontal plane when the adjusting means is moved in a downward direction.

4. An adjustable lumbar support on a chair back as claimed in claim 3 wherein the mid and lower control zones of the frame further comprising additional supports that are inflexible and support the chair back.

5. An adjustable lumbar support on a chair back as claimed in claim 1 wherein the support is wish boned-shaped.

6. An adjustable lumbar support on a chair back as claimed in claim 5 wherein the wish boned-shaped support has two members that extend to the first end of the support and mount to the upper flex zone at the top end of the frame.

7. An adjustable lumbar support on a chair back as claimed in claim 6 wherein the wish boned-shaped support has a mounting bracket at the second end of the support that is mounted to the adjusting means.

8. An adjustable lumbar support on a chair back as claimed in claim 1 wherein the adjusting means is a ratchet assembly.

9. An adjustable lumbar support on a chair back as claimed in claim 1 wherein the chair back is mesh.

10. An adjustable lumbar support on a chair back comprising: (a) a frame wherein the frame is further defined as a structure that is mounted to the chair back and mirrors a shape of a perimeter of the chair back, said frame having a top end and a bottom end, from the top end of the frame having an upper flex zone, a mid control zone, a lower flex zone, and a lower control zone; (b) a support having a first end and a second end, the first end of the support is mounted only to the upper flex zone at the top end of the frame; (c) a first adjusting means for moving the support in solely a vertical plane while allowing for the moving and flexing of the frame and the chair back in solely a horizontal plane; (d) a second, adjusting means for adjusting a chair seat along a horizontal plane when the first adjusting means is engaged; wherein the first adjusting means is mounted only to the second end of the support and the second adjusting means is only mounted to the bottom end of the frame.

11. An adjustable lumbar support on a chair back as claimed in claim 10 wherein the upper and lower flex zones of the frame flex out along the horizontal plane when the first adjusting means is moved in an upward direction solely along the vertical plane and the second adjusting means moves the chair seat outward solely along the horizontal plane.

12. An adjustable lumbar support on a chair back as claimed in claim 11 wherein the upper and lower flex zones of the frame flex in, along the horizontal plane when the first adjusting means is solely moved in an downward direction along the vertical plane and the second adjusting means moves the chair seat inward along the horizontal plane.

13. An adjustable lumbar support on a chair back as claimed in claim 10 wherein the support is wish boned-shaped.

14. An adjustable lumbar support on a chair back as claimed in claim 10 wherein the adjusting means is a ratchet assembly.

15. An adjustable lumbar support on a chair back as claimed in claim 10 wherein the upper flex zone and the lower flex zone are spaced apart by the mid control zone and the lower control zone.

* * * * *